United States Patent [19]

Hanson

[11] Patent Number: 4,782,800

[45] Date of Patent: Nov. 8, 1988

[54] DIESEL ENGINE CONTROL APPARATUS

[75] Inventor: Jay L. Hanson, Bloomington, Minn.

[73] Assignee: Thermo King Corporation, Minneapolis, Minn.

[21] Appl. No.: 92,979

[22] Filed: Aug. 24, 1987

[51] Int. Cl.[4] ..... F02P 19/02

[52] U.S. Cl. ..... 123/179 BG; 123/145 A

[58] Field of Search ..... 123/179 BG, 179 B, 179 H, 123/145 A

[56] References Cited

U.S. PATENT DOCUMENTS

| | | | |
|---|---|---|---|
| 1,884,450 | 10/1932 | Widmann . | |
| 4,088,109 | 5/1978 | Woodruff et al. | 123/179 BG |
| 4,106,465 | 8/1978 | Bernhardt et al. | 123/179 H |
| 4,207,853 | 6/1980 | Phillips | 123/179 B |
| 4,221,205 | 9/1980 | Koehler | 123/179 H |
| 4,235,215 | 11/1980 | Stotz et al. | 123/179 H |
| 4,258,678 | 3/1981 | Abe | 123/179 H |
| 4,300,491 | 11/1981 | Hara et al. | 123/179 BG |
| 4,318,374 | 3/1982 | Yasuhara | 123/179 BG |
| 4,359,643 | 11/1982 | Tada et al. | 290/38 R |
| 4,452,191 | 6/1984 | Steele | 123/179 H |
| 4,491,100 | 1/1985 | Yasuhara | 123/145 A |

*Primary Examiner*—Andrew M. Dolinar
*Attorney, Agent, or Firm*—D. R. Lackey

[57] ABSTRACT

Diesel engine control apparatus which automatically completes an engine preheating circuit in response to actuation of a momentary contact switch, but only if a predetermined Diesel engine safety circuit is closed. An engine-ready indicator is actuated after a warm-up time responsive to engine temperature. The engine preheating circuit is opened a predetermined period of time after the engine-ready indicator is actuated, or when an engine start switch is actuated, whichever occurs first. Should the preheat circuit still be closed for some reason when the Diesel engine safety circuit opens upon normal running of the Diesel engine, the safety circuit will open the preheat circuit.

3 Claims, 1 Drawing Sheet

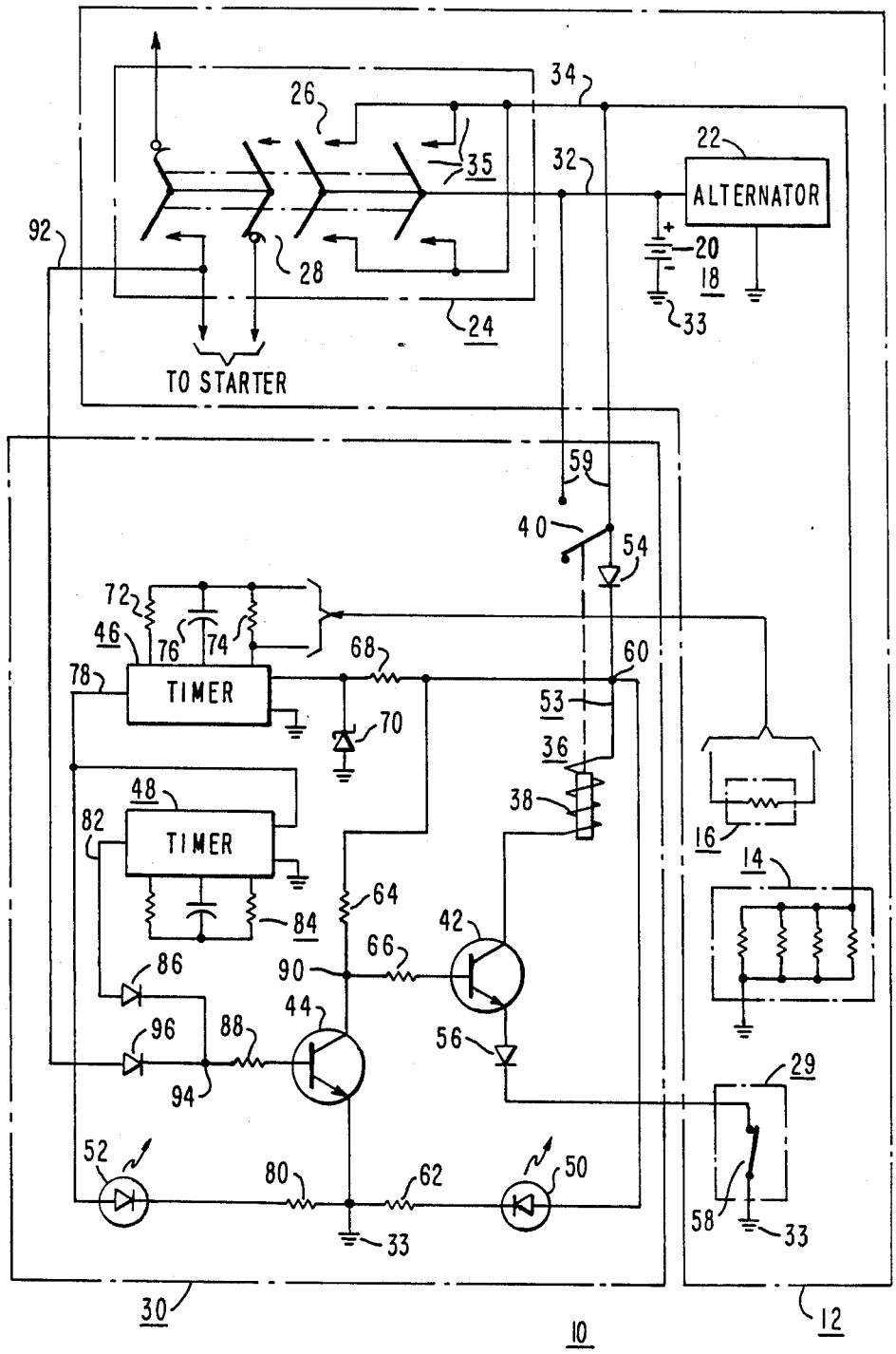
ALTERNATOR
TO STARTER
TIMER
TIMER
10
12
14
16
18
20
22
24
26
28
29
30
32
33
34
35
36
38
40
42
44
46
48
50
52
53
54
56
58
59
60
62
64
66
68
70
72
74
76
78
80
82
84
86
88
90
92
94
96

DIESEL ENGINE CONTROL APPARATUS

BACKGROUND OF THE INVENTION

1. Field of the Invention

The invention relates in general to Diesel engine control apparatus, and more specifically to Diesel engine preheat control.

2. Description of the Prior Art

The ease or difficulty involved in starting a Diesel engine depends upon the temperature of the engine. Thus, it is common to employ glow plugs to preheat the combustion chamber prior to engine crank. The lower the engine temperature, the longer the glow plugs are energized before an indication is given that the engine is ready to start.

It is an object of the present invention to provide new and improved Diesel engine preheat control apparatus.

SUMMARY OF THE INVENTION

Briefly, the present invention is a new and improved Diesel engine control apparatus for automatically controlling preheating of the engine in conjunction with an engine safety circuit. In a preferred embodiment of the invention, the safety circuit includes at least a low engine oil pressure switch which, if not defective, is closed when the engine is off and open when the engine is running normally. The oil pressure switch is connected to ground in a preheat circuit which requires such a grounded connection to enable the preheat function to be performed. Thus, when an operator actuates a momentary contact preheat switch to initiate automatic engine preheat, engine preheating will occur only if the preheat circuit is grounded through the Diesel engine protective circuit. Failure of the engine to preheat, which will be immediately apparent to the operator as a preheat indicator light will not be energized, alerts the operator to check the Diesel engine safety circuit for a malfunction.

If the Diesel engine safety circuit is not defective, normal engine preheat will occur, and after a time dictated by initial engine temperature, an engine ready-to-start light will be energized. The engine preheat circuit will maintain the automatic preheating function after the ready-to-start light is energized, but only for a predetermined period of time selected to allow the operator time to actuate the engine starting switch. Failure of the operator to initiate starting will terminate automatic preheating at the end of the predetermined period of time. Actuation of the engine starter will also terminate automatic preheating prior to the termination of the predetermined period of time, while actuation of the engine starter manually maintains engine preheating during engine cranking.

Should the automatic preheating function still be effective when the engine starts, the engine safety circuit will disconnect the automatic engine preheat circuit from ground and terminate the automatic engine preheat function, thus assuring good glow plug life even in the event the preheat control fails to terminate the preheat function.

BRIEF DESCRIPTION OF THE DRAWING

The invention may be better understood and further advantages and uses thereof more readily apparent when considered in view of the following detailed description of exemplary embodiments, taken with the accompanying drawings, in which the single FIGURE is a schematic diagram of Diesel engine preheat control apparatus constructed according to the teachings of the invention.

DESCRIPTION OF PREFERRED EMBODIMENTS

Referring now to the drawings, the single Figure is a schematic diagram of Diesel engine preheat control apparatus 10 constructed according to a preferred embodiment of the invention. While the Diesel engine control apparatus 10 is particularly suited for use with Diesel engines which function as the prime movers for the compressors of transport refrigeration systems, it will be apparent that the invention may be applied to any Diesel engine.

More specifically, Diesel engine preheat control apparatus 10 includes a Diesel engine 12 having glow plugs 14 disposed to preheat the engine 12 when electrically energized; an engine temperature sensor 16, such as an engine block or water temperature sensor; a voltage source 18, such as a battery 20 and an alternator 22; momentary contact switch means 24, which may include mutually exclusive preheat and start contact positions 26 and 28, respectively; an engine protective circuit 29; and an engine preheat control circuit 30.

One side of voltage source 18 is connected to the movable contact portion of the momentary contact switch 24 via a conductor 32, and the remaining side of source 18 is connected to engine ground 33. Make contacts on both the preheat and start sides 26 and 28 of switch 24 are connected to the glow plugs 14 via a conductor 34, such that the glow plugs are manually energized by the momentary contact switch 24 in either momentary position, by a first circuit 35 which includes conductor 32, switch 24, and conductor 34.

Engine preheat circuit 30 includes a relay 36 having an electromagnetic coil 38 and normally open contacts 40; first and second solid state switches 42 and 44, such as NPN transistors; first and second timers 46 and 48; and first and second indicator lights 50 and 52, such as light emitting diodes (LEDs).

Electromagnetic coil 38 of relay 36 is connected in a series circuit 53 which starts at conductor 34 and terminates at engine ground 33. Series circuit 33 includes a reverse polarity protection diode 54, the coil 38, the collector emitter path of transistor 42, a diode 56 and the engine protective circuit 29. Diode 56 isolates transistor 42 from the engine protective circuit 29.

Conductor 34 is energized when momentary contact switch 24 is actuated to its preheat position 26. The voltage on conductor 34 energizes indicator 50 which is connected from a junction 60 between diode 54 and coil 38 to engine ground 33 via a current limiting resistor 62. Indicator 50, when energized, indicates that the glow plugs 14 are energized and the engine is preheating.

Conductor 34, when energized, also provides base drive for transistor 42 via resistors 64 and 66 which are serially connected from junction 60 to the base of transistor 42, turning transistor 42 on. When transistor 42 switches to its conductive state, the engine protective circuit 29, if the associated protective devices are not defective, will complete the series circuit 53 to ground 33 when engine 12 is off. Thus, engine 12 will not preheat if any protective device connected in circuit 29 has not closed properly when engine 12 is shut off. Engine protective circuit 29 includes at least a low engine oil pressure switch 58 which is closed when engine 12 is off and open when the engine is running normally. Additional protective devices would have contacts connected in series with switch 58. Thus, actuating momentary contact switch 24 to the preheat position when engine 12 is not running energizes series circuit 53 when all engine protective devices have their associated contacts closed.

Relay contacts 40 are connected between conductors 32 and 34, such that when relay 36 is energized contacts 40 close to parallel the preheat contacts 26 of momentary contact switch 24, sealing-in or latching relay 36 to maintain energization of series circuit 53 from conductor 32 after the preheat contacts 26 of switch 24 open. Contacts 40, when closed, also complete a second circuit 59 for energizing glow plugs 14, which circuit includes conductor 32, contacts 40, and conductor 34, to maintain energization of glow plugs 14 once the first circuit 35 opens.

Voltage at junction 60 starts timer 46, and if relay 36 latches, the voltage persists to continue energization of timer 46. Timer 46 determines the time the engine glow plugs 14 will be heated, and thus the engine preheat time, before an indication is provided to an operator that the engine is ready to start. Resistor 68 and Zener diode 70 regulate the voltage applied to timer 46 for jump start and overvoltage protection. The timing period for timer 46 to time out and latch is established by resistors 72 and 74, capacitor 76, and the engine temperature sensor 16. Engine temperature sensor 16 has a negative temperature coefficient such that the lower the temperature of engine 12 the higher the sensor resistance, and the higher the sensor resistance the longer it takes for timer 46 to time out. The values of resistors 72 and 74 and capacitor 76 are selected such that if sensor 16 should fail open, timer 46 would time out in a predetermined maximum time, and if sensor 16 should fail in a shorted failure mode, timer 46 would time out in a predetermined minimum time, with the predetermined maximum and minimum times being selected according to the type of glow plugs used.

When timer 46 times out and latches it energizes a conductor 78. Indicator 52 is connected from conductor 78 to ground 33 via a voltage limiting resistor 80, to provide an indication to an operator when timer 46 times out that the engine 12 has been sufficiently preheated and is ready to start.

Conductor 78 is also connected to the "start" input of timer 48, energizing timer 48 and causing it to time a predetermined period of time and then time out and apply a voltage to a conductor 82. The timing period of timer 48 is determined by an RC network 84. The timing period of timer 48 is selected to provide ample time for an operator to initiate starting of engine 12 after indicator 52 is energized, with ten seconds being an exemplary value.

If an operator does not attempt to start engine 12 before timer 48 times out, when timer 48 times out the voltage on conductor 82 provides base drive for transistor 44 via an isolating diode 86 and a current limiting resistor 88, turning transistor 44 on. When transistor 44 turns on it connects the junction 90 between resistors 64 and 66 to ground, turning transistor 42 off, deenergizing relay 36 and opening relay contacts 40. Thus, the preheat indicator 50 and glow plugs 14 are deenergized, and timers 46 and 48 are reset.

When engine start is initiated, contacts on the start side 28 of momentary contact switch 24 are connected to source 18 via conductor 32, which manually maintains energization of glow plugs 14, if they are already energized, or manually initiates energization of the glow plugs if they are de-energized. Engine start initiation also energizes a conductor 92 which is connected to junction 94 between diode 86 and resistor 88, via an isolating diode 96, with the same effect as when timer 48 times out, i.e., transistor 44 turns on to turn transistor 42 off, if on, or to prevent transistor 42 from turning on, if off.

If actuation of the start side 28 of momentary contact switch 24 results in starting of engine 12, the engine safety circuit 29 will open to remove the ground connection of the series circuit 53, insuring that relay 38 and glow plugs 14 will be deenergized after the engine is running.

In summary, there has been disclosed Diesel engine control in which an engine preheating circuit is connected to engine ground and rendered operative only when the engine is off and an engine protective circuit has closed its associated contact, or contacts, to make the necessary ground connection.

I claim as my invention:

1. Diesel engine control apparatus, comprising:

a Diesel engine having glow plugs and a temperature sensor, a voltage source, a momentary contact switch, said momentary contact switch, when actuated, completing a first circuit which connects the voltage source to the glow plugs, a safety circuit which is open when the Diesel engine is running normally and closed when the Diesel engine is off, and automatic glow plug preheat control means having a ready-to-start indicator, said preheat control means being connected to said safety circuit, and connectable to said voltage source via said momentary contact switch, said preheat control means being operative when the momentary contact switch is actuated and the safety circuit is closed to comprise a second circuit which connects the voltage source to said glow plugs, said preheat control means including a first timer for controlling the actuation of said ready-to-start indicator after the voltage source has been connected to the glow plugs via the second circuit for a time responsive to said temperature sensor, said preheat control means including a second timer for initiating opening of the second circuit a predetermined period of time after actuation of the ready-to-start indicator, said preheat control means including a solid state switch, and a latching relay having an electromagnetic coil and normally open contacts, with said normally open contacts being connected across the momentary contact switch, and wherein the second circuit which connects the voltage source to the glow plugs includes said normally open contacts, with the actuation of the momentary contact switch rendering the solid state switch conductive, to energize the electromagnetic coil and close the normally open contacts of the latching relay, and wherein the opening of the safety circuit drops out the latching relay and renders the solid state switch non-conductive, to open the normally open contacts of the latching relay and the second circuit which connects the voltage source to the glow plugs.

2. The Diesel engine control apparatus of claim 1 including switch means for starting the Diesel engine, and including means responsive to the switch means when the switch means is actuated for rendering the solid state switch non-conductive, to drop out the latching relay, open the normally open contacts, and open the second circuit which connects the voltage source to the glow plugs.

3. The Diesel engine control apparatus of claim 1 wherein the safety circuit, when closed, connects the solid state switch to engine ground.

* * * * *